US007085198B2

(12) United States Patent
Münzenberger et al.

(10) Patent No.: US 7,085,198 B2
(45) Date of Patent: Aug. 1, 2006

(54) METHOD FOR PRODUCING COMPUTER-ASSISTED REAL-TIME SYSTEMS

(75) Inventors: Ralf Münzenberger, Erlangen (DE); Frank Slomka, Erlangen (DE); Matthias Dörfel, Emmering (DE); Oliver Bringmann, Kassel (DE)

(73) Assignee: Friedrich-Alexander-Universitat Erlangen-Nurnberg, Erlangen (DE)

( * ) Notice: Subject to any disclaimer, the term of this patent is extended or adjusted under 35 U.S.C. 154(b) by 519 days.

(21) Appl. No.: 10/363,635

(22) PCT Filed: Sep. 3, 2001

(86) PCT No.: PCT/DE01/03349

§ 371 (c)(1),
(2), (4) Date: May 19, 2003

(87) PCT Pub. No.: WO02/21261

PCT Pub. Date: Mar. 14, 2002

(65) Prior Publication Data

US 2004/0027924 A1 Feb. 12, 2004

(30) Foreign Application Priority Data

Sep. 6, 2000 (DE) ..... 100 44 021
Nov. 21, 2000 (DE) ..... 100 57 651

(51) Int. Cl.
*G04F 10/00* (2006.01)

(52) U.S. Cl. ..... 368/119; 702/176; 702/187; 713/375

(58) Field of Classification Search ..... 368/118, 368/119; 375/354, 356, 362; 702/89, 176–178, 702/186, 187; 713/375, 400
See application file for complete search history.

(56) References Cited

FOREIGN PATENT DOCUMENTS

EP 0 903 655 A2 3/1999

OTHER PUBLICATIONS

Marchioro G F et al: "Transformational partitioning for codesign", pp. 181-195, May 1998.
Patel A et al: "A timestamp model for determining real-time communications in intelligent networks", pp. 211-218, Jun. 28, 1996.
Kopetz H et al: "Clock Synchronization in Distributed Real-Time Systems", pp. 933-940, Aug. 1987.

(Continued)

*Primary Examiner*—Kamand Cuneo
*Assistant Examiner*—Jeanne-Marguerite Goodwin
(74) *Attorney, Agent, or Firm*—Rankin, Hill, Porter & Clark LLP

(57) ABSTRACT

A method for producing a computer-assisted real-time system that includes at least one processing unit. Data exchange between the processing unit and the environment or one or more additional processing units is synchronous or asynchronous. At least one real clock is allocated to the processing unit to correlate data exchange.

16 Claims, 10 Drawing Sheets

OTHER PUBLICATIONS

Bringmann, O., u.a: Mixed Abstraction Level Hardware Synthesis from SDL for Rapid Prototyping; in Rapid System Prototyping, 1999, IEEE Int. Workshop on, 1999, pp. 114-119.

Dou, C.: Integration of SDL and VHDL for HW/SW Codesign of Communication Systems; In: Euromicro '97, New Frontiers of Information Technology, Proc. of the 23rd EUROMICRO Conf . . . 1997, pp. 188-195.

Daveau, J-M., u.a.: Protocol Selection and Interface Generation for HW-SW Codesign; In: IEEE Trans. on Very Large Sacle Integration (VLSI) Systems, vol. 5, No. 1, Mar. 1997, pp. 136-144.

Helbig, T., Rothermel, K.: Synchronisation multimediater Datenstrome; In: it+ti, Apr. 1995, pp. 18-25.

Mills, D.: Improved Algorithms for Synchronizing Computer Network Clocks; In: IEEE/ACM Trans. on Networking, vol. 3, No. 3, Jun. 1995.

Characteristics of the real-time discrete clock
[accuracy, accuracy function, start offset, granularity, value range];
Characteristics of the controlled counter:
[reference clock, number of changes, delay time, value range];

Characteristics of the clocks in process A:
$define Clock Clock 1 [0.00001, 0, 1 µs, 10 ms, 100 ms];
$define Clock Clock 2 [0.00001, 0, 2 µs, 10 ms, 100 ms];

Characteristics of the clocks in process B:
$define Clock Clock1 [0.00002, 0, 2 µs, 10 ms, 90 ms];
$define Clock Clock3 [RefUhr1, 3, 2 ns, 2];

Characteristics of the reference clock:
$define Clock RefClock1 [0.00001, 0, 1 µs, 1 ms, 100

```
newtype Clock
operat rs
   mkClock: Integer -> Clock;
   getTime: Clock, TimeUnit -> Time;
   getTicks: Clock -> Integer;
   setEventTime: Clock, Eventclass, Time -> Void;
   setConditionTime: Clock, Boolean, Time -> Void;
   setTimer: Clock, Time, Timer -> Void;
   resetTimer: Clock, Timer -> Void
axioms
   "mkClock(Integer PhysicalClock):
      PhysicalClock is a reference to the physical clock,
      the response of the physical clock is specified using an SDL* annotation, the
      clock starts with the value ZERO"
   "getTime(Clock Clock1, TimeUnit Unit):
      is the time indication of Clock1,
      the return value is the time interval between the last setting of Clock1 and now,
      Unit indicates the unit of the response value"
   "getTicks (Clock Clock1)
      is the tick branch of Clock1,
      the return value is the number of ticks since the last setting of Clock1"
   "setEventTime (Clock Clock1, Eventclass A, Time NewTime):
      the indication of Clock1 is set,
      A is the initiating event for setting the clock
      the clock is set to the value NewTime"
   "setConditionTime(Clock Clock1, Boolean Condition, Time NewTime):
      the indication for Clock1 is set
      if Condition is true
      the clock is set to the value NewTime"
   "setTimer(Clock Clock1, Time ExpireTime, Timer TimerName):
      Clock1 is the clock for the timer (new in comparison to set and reset in SDL),
      ExpireTime is the elapsed time of the timer,
      TimerName is the name of the timer;
   "resetTimer(Clock Clock1, Timer TimerName):
      TimerName is the name of the timer"
endnewtype Clock:
```

```
syntype Clock1 Integer = 10;
/*SDL* Clock annotation to specify the physical characteristic of a clock
$define Clock Clock1 [0.00001, 0, 1 us, 10 ms, 100 ms];*/
```

```
newtype TimeUnit
literals s, ms, us, ns;
 /* previously defined*/
endnewtype Void;
```

```
newtype Void
literals bottom,
endnewtype Void;
```

*Fig. 4a*

```
newtype Eventclass
operators
    mkEventclass: ActivationStatus, EventKind, Integer, Integer -> Eventclass;
    append: Eventclass -> Void;
    getTimeEvent: Eventclass, Integer -> Time;
    removeEvent: Eventclass, Integer -> Void
    nbOfEvents: Eventclass -> Integer;
    durationEvent: Eventclass, Integer, Eventclass, Integer -> Duration;
    throwException: Eventclass, Eventclass, Integer, Integer -> Void;
    monitor: Eventclass, Eventclass, Integer, Integer -> Void;
axioms
"mkEventclass (ActivationStatus AS, EventKind EK, Integer PhysicalClock, Integer NoOfEvents):
    Other operators may or may not be carried out depending on AS,
    EK specifies the nature of events which are handled by an event class
    PhysicalClock is a reference to the clock, response is specified using an SDL* annotation,
    NoOfEvents specifies the maximum number of stored events in Eventclass"
"append(Eventclass A):
    stores an event with the current time stamp in a data structure
    is carried out unless ActivationStatus is ActivateNone"
"getTimeEvent(Eventclass A, Integer EventIndex):
    return to the time stamp for an event from A, referenced by EventIndex,
    is carried out unless ActivationStatus is ActivateNone"
"removeEvent(Eventclass A, Integer EventIndex):
    remove an event from A, referenced by EventIndex,
    is carried out unless ActivationStatus is ActivateNone"
"nbOfEvents(Eventclass A):
    returns the number of stored events in A,
    is carried out unless ActivationStatus is ActivateNone"
"durationEvent(Eventclass A, Integer Index1, Eventclass B, Integer Index2):
    return the time interval between an event from B, referenced by Index2, and an event from A, referenced by
    Index1 (time stamp for the event from B minus the time stamp for the event from A), is carried out unless
    ActivationStatus is ActivateNone"
"throwException(Eventclass A, Boolean TemporalCondition, Eventclass B, Boolean LogicalCondition):
    initiates exception processing as a function of process-internal events,
    TemporalCondition is the time condition which is true when the time condition is satisfied,
    LogicalCondition describes the validity of the time condition and is true when the logical condition is
    satisfied,
    Exception processing is initiated when TemporalCondition is not true and LogicalCondition is true,
    when an event class being used has no stored events or an event in a nonexistent event class is used, no
    exception processing is carried out,
    is carried out when ActivationStatus is ActivateAll or ActivateException"
"monitor(Eventclass A, Boolean TemporalCondition, Eventclass B, Boolean LogicalCondition):
    for explanation see throwException,
    is carried out when ActivationStatus is ActivateAll or ActivateMonitor"
endnewtype Eventclass;
```

```
newtype ActivationsStatus
literals
    ActivateAll, ActivateNone, ActivateException, ActivateMonitor;
endnewtype ActivationStatus;
```

*Fig. 4b*

METHOD FOR PRODUCING COMPUTER-ASSISTED REAL-TIME SYSTEMS

The invention relates to a method for producing computer-aided real-time systems having at least one processing unit according to the precharacterizing clause of claim 1. It also relates to a computer system which is designed to carry out the method.

The expression real-time systems means, in general, systems which have to supply a specific computation result at a predetermined time and/or after a predetermined time interval has elapsed. For example, the time involved for converting speech to digital signals and to transmit them, and then to convert the digital signals back to analogue audio signal is about 250 ms, that is to say communication via mobile telephones takes place with a time delay of 250 ms. If the time delay is greater than 250 ms, then the transmitted speech is no longer comprehensible.

Computer-aided real-time systems having a number of processing units, so-called distributed real-time systems, are widely used according to the prior art. For example, such systems include mobile telephones, their switching systems and networks around such a distributed real-time system.

A distributed real-time system may comprise a number of processing units. These may be components of one and the same apparatus. However, it is also possible for the processing units, for example a mobile telephone and a switching system, to be physically separated from one another.

Distributed real-time systems are produced on the basis of abstract specifications, such as the "Specification and Description Language" (ITU-T.Z.100, Appendix I.ITU, SDL Methodology Guidelines, ITU, 1993), which is known by the abbreviation "SDL". SDL is based on the technical principle of each processing unit and each process having an associated queue. It is absolutely essential for the data interchange or communication which normally takes place via a bus to take place between the processing units exclusively via the queue, with all the processes running in parallel.

In order to correlate the data interchange, each processing unit also has at least one associated so-called timer module. These are numerical counters whose counting periods are not standardized but can be derived from the process clock. This is dependent on the respectively chosen hardware and/or on the respective program. This has meant that until now, it has not been reliably possible to automatically implement an abstract specification for the hardware and software of the real-time-dependent layers in a communications system. The implementations are either too slow or do not comply with the boundary time conditions. In order to overcome this disadvantage, the hardware is specified and then implemented with the aid of circuit diagrams or by means of hardware description languages. The software is generally implemented by means of programming languages. The known method is time-consuming, costly, and susceptible to faults.

In addition to SDL, other implementation languages exist, in which clocks can be included as components. For example, the Unified Modeling Language, which is known by the abbreviation "UML", makes use of clocks. A further implementation language is the Very High speed integrated circuit hardware Description Language, which is known by the abbreviation "VHDL". Neither UML nor WHDL includes the provision of queues.

A method of this generic type for producing a computer-aided real-time system is known from Kopetz, H., Ochsenreiter, W.: Clock Synchronization in Distributed Real-Time Systems; in IEEE Trans. on Computers, Vol. C36, No. 8, August 1987. The abovementioned document does not include any specification of a real-time clock which overcomes the abovementioned disadvantages from the prior art.

The object of the invention is to overcome the disadvantages from the prior art. The aim, in particular, is to specify a method by means of which real-time systems can be produced, easily, quickly and at low cost. Another aim is to allow automatic implementation of an abstract specification for real-time systems. A further aim of the invention is to avoid faults in the production of real-time systems.

This object is achieved by the features of claims 1 and 10. Expedient refinements can be found from the features in claims 2 to 9.

According to the invention, a method is provided for producing a computer-aided real-time system having at least one processing unit, in which the real-time clock is defined by the following relationship:

$$C_r(t) = \left\lfloor \frac{C_c(t)}{T} \right\rfloor G_r \bmod R_v,$$

where $C_r(t) \in \mathbb{R}$ in [s]

where $R_v$: value range, $R_v \in \mathbb{R}$ in [s]

$G_r$: granularity, $G_r \in \mathbb{R}$ in [s], where $G_r$ and $R_v$ are normalized with respect to the smallest unit that occurs, T: clock period, $T \in \mathbb{R}$ in [s], where $C_c(t)=[1+g]\cdot C_i(t)+G(p^+,t)+S_o$, where $C_c(t) \in \mathbb{R}$ in [s]

$C_i(t)=t$; $t \in \mathbb{R}$ in [s]

g: accuracy of the clock, $g \in \mathbb{R}$ for example the crystal accuracy in ppm.

$g(p^+,t)$ changing the accuracy of the clock with respect to time as a function of physical variables, represented by the vector $p^+$, for example the temperature $g(p^+,t) \in \mathbb{R}$ $$G(p^+, t) = \int_{t_1}^{t_2} g(p^+, t)dt,$$

as the effective change in the accuracy in a time interval $(t_2-t_1)$, $G(p^+,t) \in \mathbb{R}$ in [s]

$S_o$: start offset, $S_o \in \mathbb{R}$ in [s]

The method according to the invention allows data, data packets or data streams in a computer system to be marked by an accurate time marker which is independent of the system logic. This opens up completely new freedoms for specification, in particular for distributed real-time systems. A specification produced on the basis of the method according to the invention overcomes the implementation problems according to the prior art. The real time response can be taken into account even during the analysis of the functional and time response, and the subsequent specification. The proposed method makes it possible to specify a universal design pattern, which is suitable for production, in particular of distributing real-time systems, in the most widely differing application areas. The formal consideration of time requirements that is made possible by the method according to the invention furthermore allows the real-time-dependent layers in a communications system to be specified and, from this, allows efficient implementations to be derived automatically.

It is also possible to define relationships between the clocks in distributed real-time systems which are not implemented in one apparatus. By way of example, the offset between two clocks with respect to the time t is given by the relationship:

$$O^{ij}(t)=C_r^i(t)-C_r^j(t)$$

Synchronization algorithms, by way of example, can be specified and validated using this model.

A numerical counter which is associated with the processing unit can be controlled by means of the clock. When a number of clocks are used, one of the clocks is advantageously used as a reference clock for synchronization of the other clocks. This allows data to be interchanged in an organized manner between the processing units.

In this context, the expression "environment" means a technical process. The data interchange with the processing units can expediently be carried out under real-time control, for open-loop or closed-loop control of a technical process. In this context, the technical processes may, for example, be control of a chemical factory, an antilock braking system for a motor vehicle, a mobile radio network or the like.

A data stream which is received by a processing unit and is formed from a sequence of data packets can expediently be decoupled from a transmitted data stream such that the transmitted data stream need not have the same data packet sequence as the received data stream. It is thus possible to administer different real-time-dependent data streams on the Internet. The transmission speed can be increased drastically for some data streams. There is no longer any need to sequentially process the sequence of data packets arriving at the processing unit, or to pass them on again in the same sequence.

The processing unit may have an associated queue. The queue is advantageously time-controlled, preferably by means of the further clock according to the invention that is used as the reference clock. It is thus possible to write data to the queue, or read data from the queue, under time control.

According to a further refinement feature, the data packets are provided with a real time marker which is produced by the clock. Marking by means of real time markers makes it possible to transmit a predetermined sequence of data packets, with the sequence being changed for transmission, and the predetermined sequence of the data packets subsequently being reproduced. This allows the transmission speed to be increased.

It is particularly advantageous to use the clock to define time limits, in particular time conditions or time requirements. The expression time conditions means the condition in which the system carries out a predetermined action at a predetermined time. Time requirements, on the other hand, are requirements for the system that a specific event must have occurred after a predetermined time has elapsed. This may be an external event.

On the basis of a further measure according to the invention, a computer system is provided which is suitable for carrying out the method according to the invention. A computer system such as this allows precise, automatic implementation of abstract specifications of software and hardware for real-time systems, in a quick and simple manner.

Preferred exemplary embodiments of the method according to the invention will be explained in more detail in the following text. In the figures.

Figure 5:
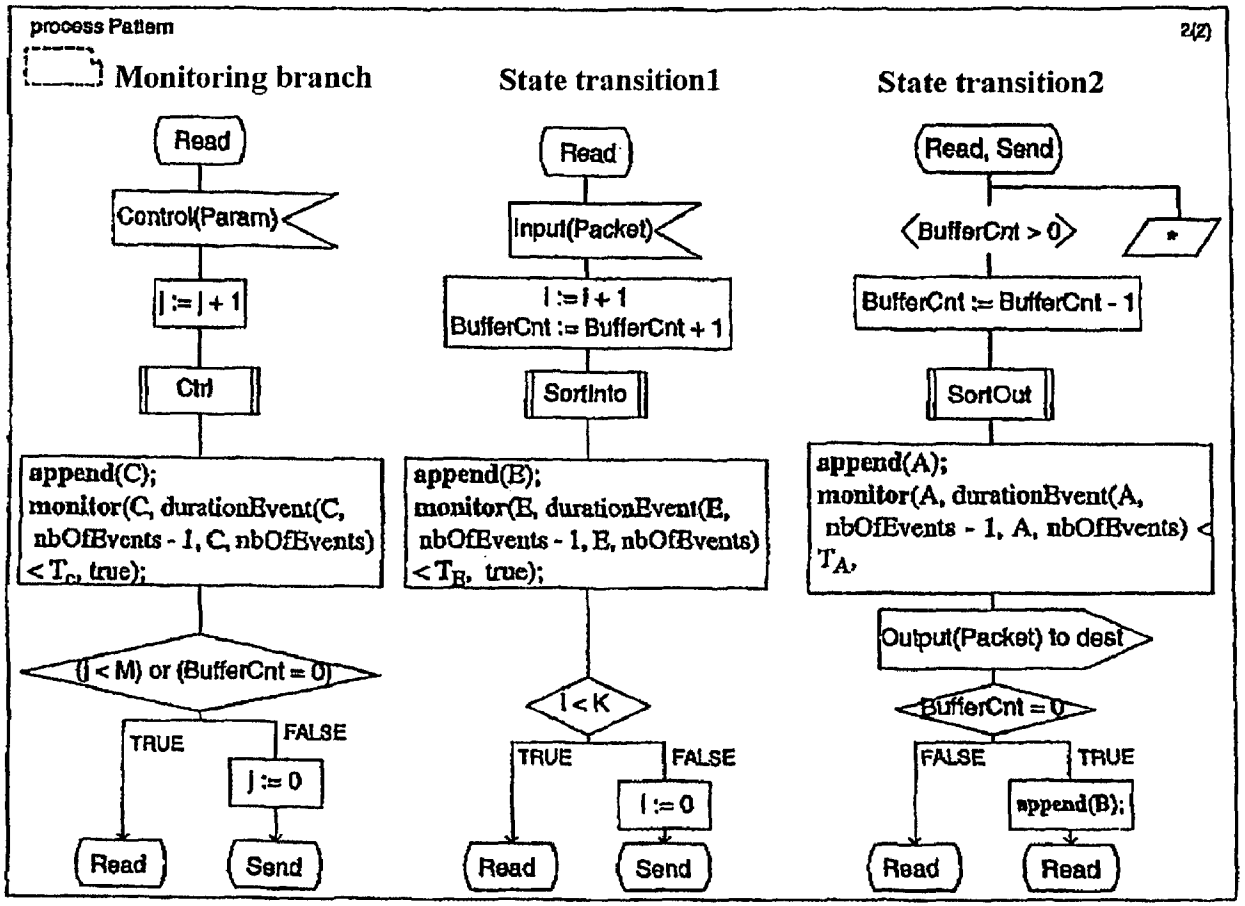
Figure 6:
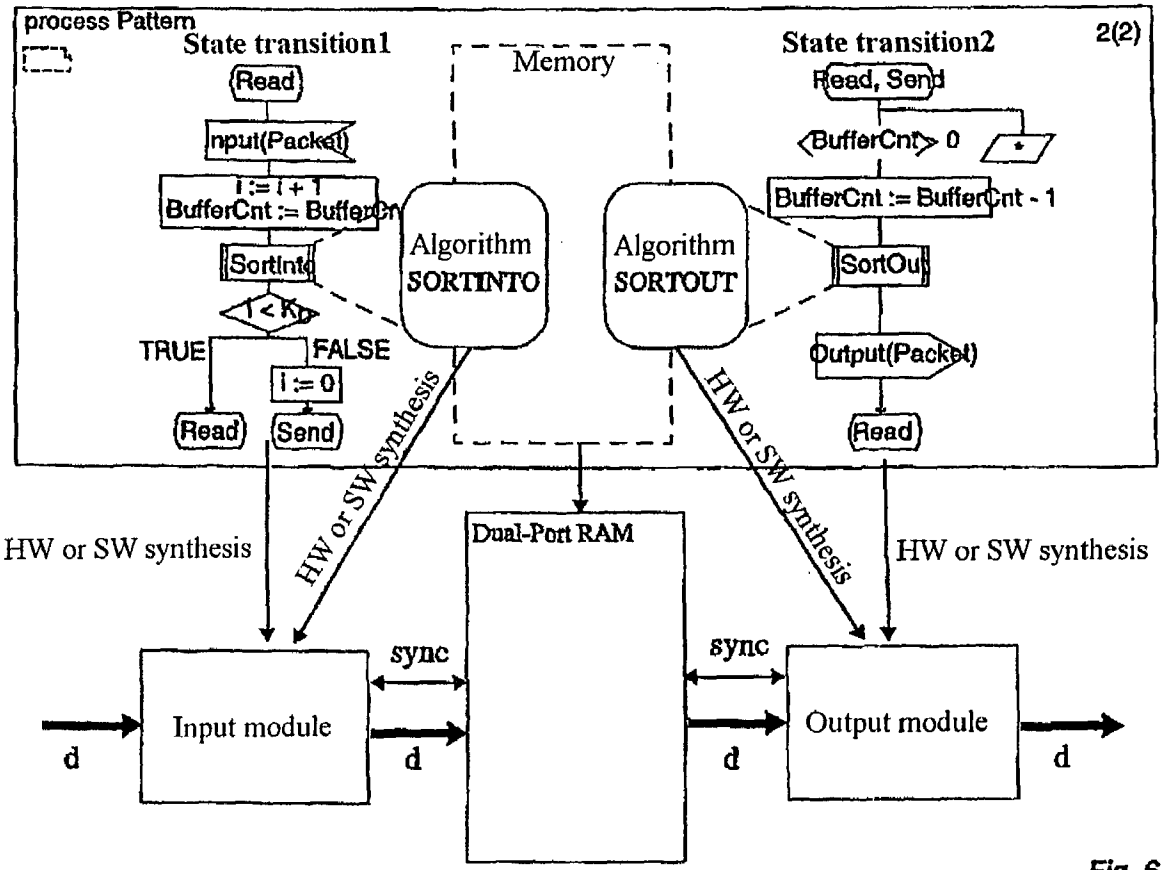
Figure 7:
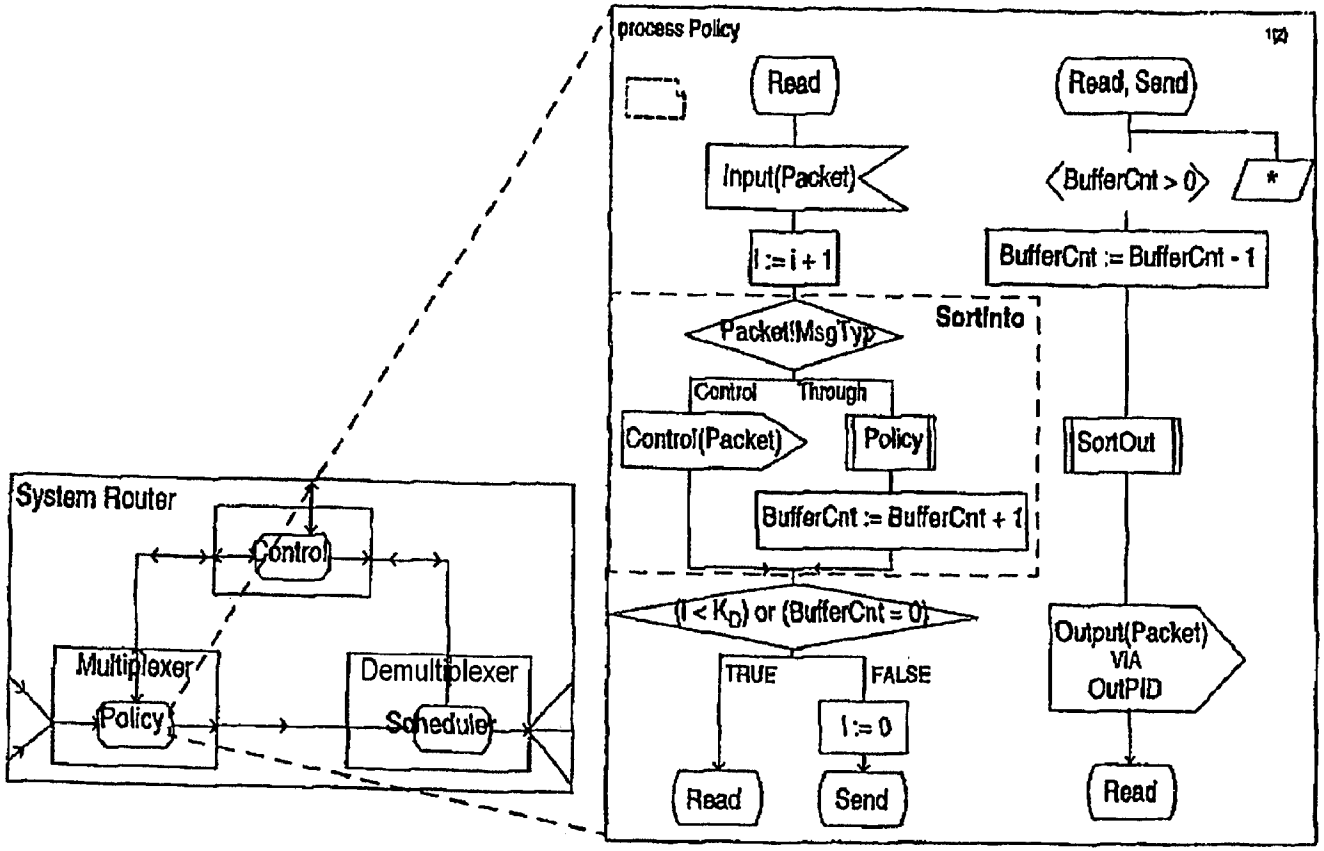
Figure 8:
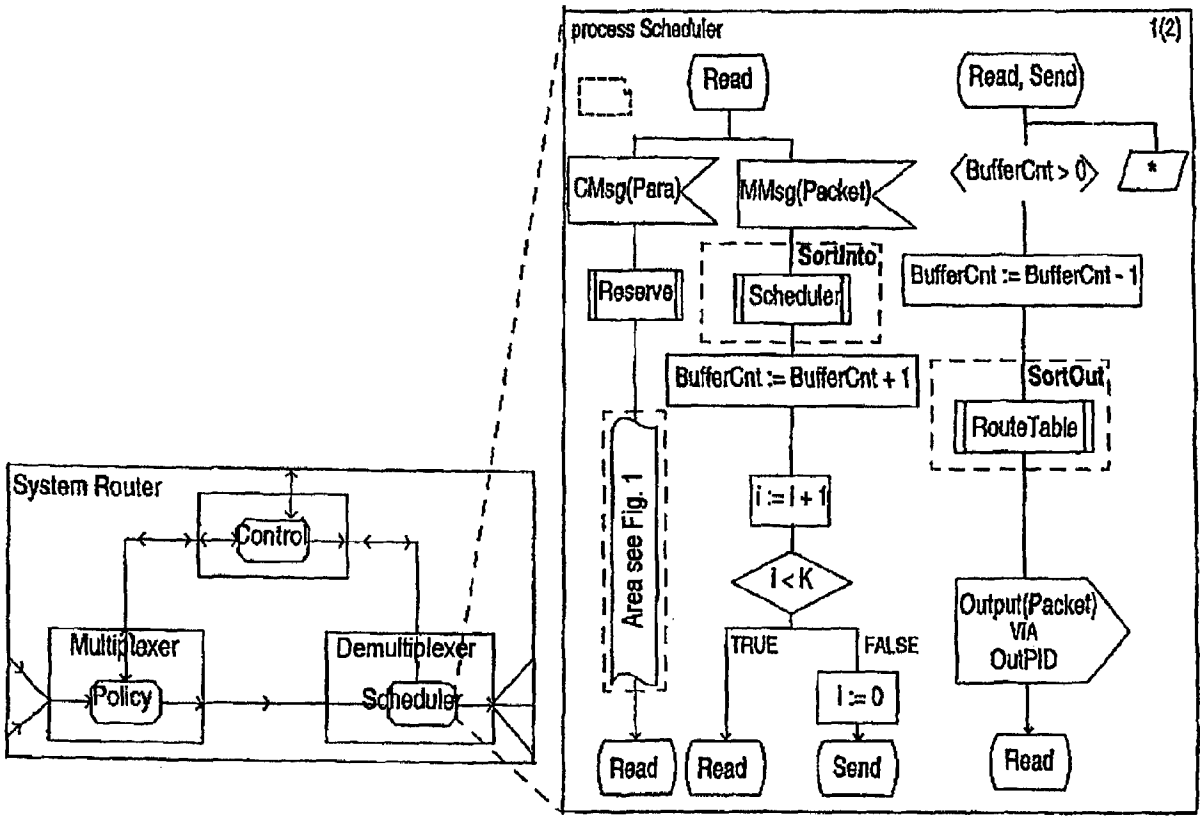

FIG. 4*a* shows the specification for clocks and access relating to abstract data types, FIG. 4*b* shows the specification of time limits and access relating to abstract data types, FIG. 5 shows the specification of time requirements and access relating to abstract data types, FIG. 6 shows the implementation of a design pattern, FIG. 7 shows the specification of a switching computer with traffic monitoring, and FIG. 8 shows the configuration of the outputs of the switching computer shown in FIG. 7.

Figure 1:
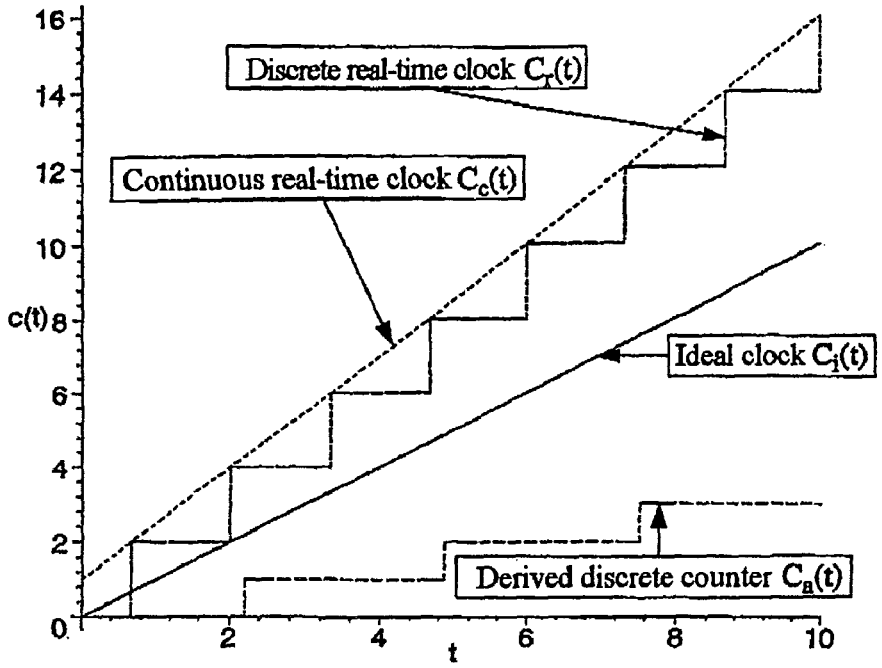
FIG. 1 shows a graph for defining the real-time clock.

FIGS. 9*a–d* show the specification with various architecture variants,

FIG. 1 explains the differences between an ideal counter, a continuous real counter, a discrete real counter and a derived counter. An ideal clock is defined by a linear function.

Ideal Clock:

The solid line in FIG. 1 shows the function of the ideal clock based on the following formula:

$$C_i(t)=t;\ t\in\mathbb{R} \text{ in [s]}$$

The continuous real clock requires further parameters. The continuous real clock has a constant accuracy which is usually specified in parts per million (ppm).

In addition, it must be remembered that the clock period of a continuous real clock can fluctuate due to fluctuations in physical parameters, such as the temperature. This is expressed by a function $g(p^+,t)$ where $p^+$ is a vector with the required physical parameters as a function of their rates of change. However, the function $g(p^+,t)$ is not used in the equation for a continuous real-time clock, since there may be periodic fluctuations, but rather the function $$G(p^+,t)=\int_{t_1}^{t_2} g(p^+,t)dt$$

for the effective accuracy change $$G(p^+,t)\in\mathbb{R} \text{ in [s]}$$

If, for example, periodic fluctuations occur, it is possible to average the clock inaccuracies over a time interval $(t_2-t_1)$. Using these definitions, the continuous real-time clock is described by the following equation:

$$C_c(t)=[1+g]\cdot C_i(t)+G(p^+,t)+S_o,\ \text{where } C_c(t)\in\mathbb{R} \text{ in [s]}$$

$$C_i(t)=t;\ t\in\mathbb{R}, \text{ in [s]}$$

g: accuracy of the clock $g\in\mathbb{R}$, for example the crystal accuracy in ppm.

$g(p^+,t)$ changing the accuracy of the clock with respect to time as a function of physical variables, represented by the vector $p^+$, for example the temperature $g(p^+,t)\in\mathbb{R}$ $$G(p+,t)=\int_{t_1}^{t_2} g(p^+,t)dt,$$

as the effective change in the accuracy in a time interval $(t_2-t_1)$ $G(p^+,t)\epsilon\mathbb{R}$ in [s]

$S_o$: start offset, $S_o\epsilon\mathbb{R}$ in [s]

A technical process cannot be resolved into infinitely short time intervals. Any physical clock oscillates at a finite frequency. The frequency is correlated with the clock period T of the clock. The shortest legible interval for a discrete real-time clock is defined as granularity G. The formal mapping of the ideal clock onto the discrete real-time clock is given by the following relationship:

Discrete Real-time Clock:

$$C_r(t)=\left\lfloor\frac{C_c(t)}{T}\right\rfloor G_r \bmod R_v,$$

where $C_r(t)\epsilon\mathbb{R}$ in [s]

where $C_r(t)\epsilon\mathbb{R}$ $R_v$: value range, $R_v\epsilon\mathbb{R}$ in [s]

$G_A$: granularity, $G\epsilon\mathbb{R}$ in [s], where G and $R_v$ are normalized with respect to the shortest unit which occurs.

T: clock period, $T\epsilon\mathbb{R}$ in [s].

The quantization of the time is described by the operation $$\left\lfloor\frac{C_c(t)}{T}\right\rfloor G_r.$$

$R_v$ describes the value range of the discrete real clock. After $R_v$ time limits, the discrete real-time clock indicates 0 once again. This is described by the modulo operation in the equation. The inaccuracy $G(p^+,t)$ does not appear directly here. The clock period T, the granularity $G_r$, the start offset $S_o$ and the value rate $R_v$ must be specified in seconds.

A counter which is controlled by the discrete clock $$\left\lfloor\frac{C_c(t)}{T}\right\rfloor$$

is described by the following relationship, $$C_A(t)=\left\lfloor\frac{\left\lfloor\frac{C_c(t-\tau)}{T}\right\rfloor}{N_A}\right\rfloor G_A \bmod R_A,$$

where $C_A(t)\epsilon\mathbb{R}$

T: clock period of the discrete real clock $T\epsilon\mathbb{R}$ in [s], $N_A$: number of changes $N_A\epsilon\mathbb{N}$ $G_A$: granularity of the derived counter, $G_A\epsilon\mathbb{N}$ $R_A$: value range of the derived counter, $R_A\epsilon\mathbb{N}$ $\tau$: delay time, $\tau\epsilon\mathbb{R}\cup\{o\}$ in [s].

The delay time for the setting of the derived counter is $\tau$. $N_A$ describes the number of indication changes for the discrete real-time clock until the counter indication changes once. The granularity $G_A$ indicates the indication interval change. $R_A$ describes the value range of the derived counter.

Figure 2:
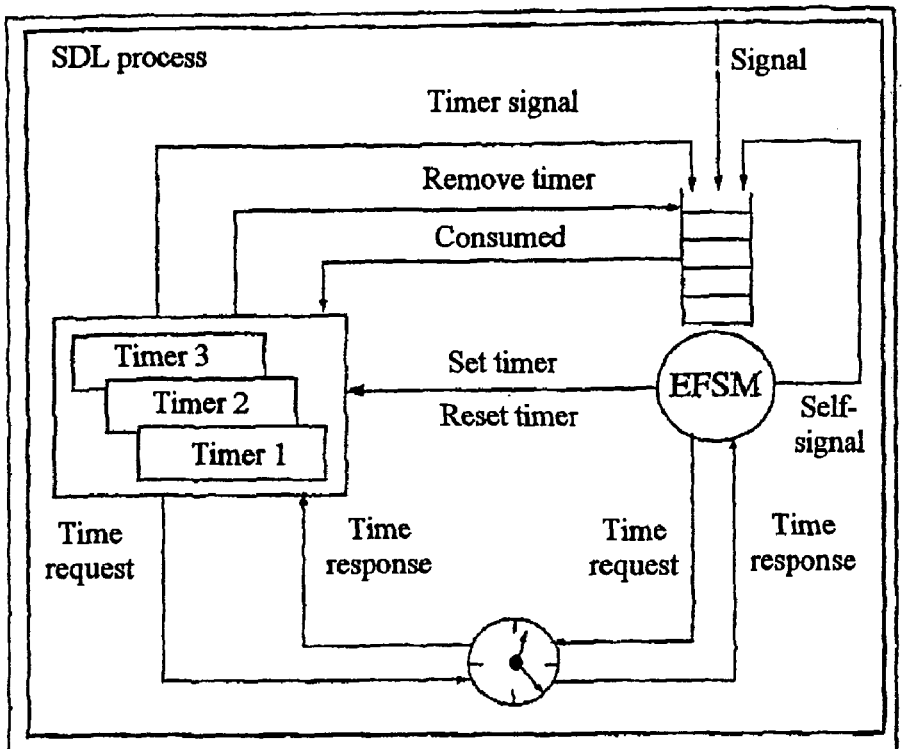
FIG. 2 shows, schematically, the SDL process with a real-time clock.

FIG. 2 shows, schematically, the structure of a processing unit in SDL, and a so-called "SDL process". One or more timers provided on the basis of the conventional SDL concept are, according to the invention, connected to one real-time clock. As is evident from FIG. 3, it is thus possible to synchronize the timers for different SDL processes.

Figure 3:
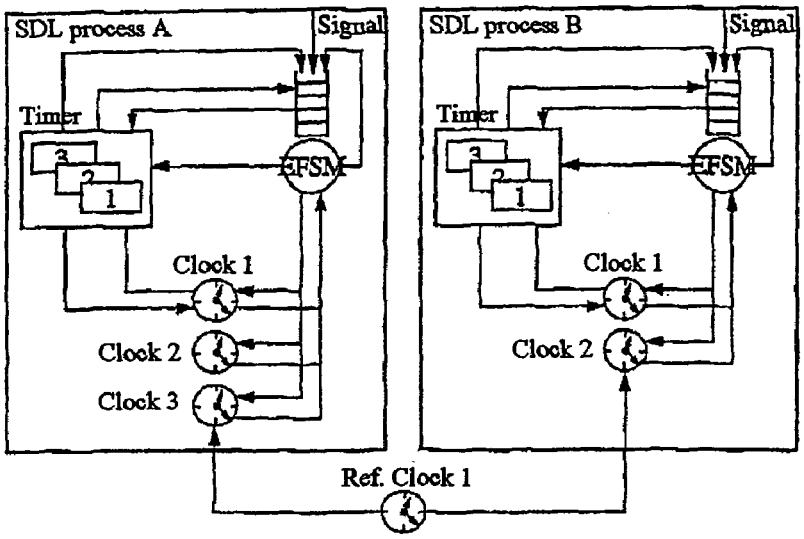
FIG. 3 shows a synchronized distributed real-time system using SDL.

An arriving signal as shown in FIGS. 2 and 3 can be provided with a time stamp, which in this case is a real time marker.

FIG. 4*a* shows the definition of a set of abstract data types in SDL, by means of which it is possible to access the indication of the real-time clocks, to reset the real-time clocks, or to set them to predetermined values relating to specific real times.

The method according to the invention allows design patterns to be specified for automatic derivation of hardware and software of embedded distributed real time systems. One expedient component of such a design pattern is the formulation of time limits. It is necessary, in particular, for this purpose, for the programming languages used to be able to generate time markers. This may be done, for example by requesting the system time. Possible time requirements for a design pattern such as this—as shown in FIG. 5 by way of example—are:

a) The first time requirement for the periodic occurrence of the state READ, that is to say for carrying out the monitoring branch and state transition 1. The first time requirement results from the rate at which the data stream is received. This specifies that, on a statistically average basis, the number of data words which can be read from the queue is precisely the same as the maximum number that can be written to it. The first time requirement is applicable only when the queue contains data words.

b) The second time requirement specifies that, for a medium which supports the data rate R, an "output" signal for loading the medium must be produced every 1/R time units. The second time requirement is applicable only when data words are stored in the memory of the design pattern.

The "Eventclass" data type which is shown in FIG. 4*b* provides, inter alia, the following operations, which are suitable for definition of time conditions and time requirements:

| | |
|---|---|
| Append: | enters the current system time in a list of time stamps; |
| Durationevent: | calculates the time duration between two time stamps entered in the list, and |
| Monitor: | in the event of a fault, records the results of the time check and writes these results to an appropriate output appliance. |
| ThrowException: | Calls exception processing in the event of a fault, in order, for example, to change the system to a safe state. |

Examples for implementation of modules with the aid of the pattern:

The respective functionality of the pattern in different applications or as a module is in the end defined by the functions SortInto( ) and SortOut( ). If the design pattern is used in communication systems, for example for implementing sequence planning algorithms, time-division or frequency-division multiplexers or bandwidth allocations, the function SortInto( ) of each data word is provided with a time stamp. SortOut( ) then reads the data words in a defined sequence on the basis of their time stamps. Furthermore, it is possible to carry out traffic monitoring(Policy) in the function SortInto( ). In the process, the determination is made as to whether the transmitter of a data stream includes an agreed Quality of Service (QoS). At this point, inter alia, the routing information (address, telephone number or path number in ATM) for the packet can also be evaluated, and the destination of the transmission function defined.

When implementing open-loop or closed-loop control algorithms, on the other hand, the respective manipulated variable calculation is carried out in the function SortOut( ) while the function SortInto( ) stores the sensor values (controlled variables).

In this way, a number of values can first of all be collected before the actual calculation is carried out.

Automatic Derivation of Mixed HW/SW Systems:

The design pattern described in the previous section can be transferred very easily to an implementation. State transition 1 and state transition 2 are considered separately for this purpose. This is because this decoupling makes it possible to define a specific software or hardware module for each state transition. In this case, the respective input or output module may also once again represent a mixed HW/SW implementation. The input and output transitions of the module can in this case invariably be carried out such that they overlap (pipelining), since synchronization between the two state transitions can be achieved via the shared memory of the internal buffer. A procedure such as this allows the implementation complexity to be reduced drastically, and the rate at which it can be carried out to be increased noticeably. By way of example, FIG. 6 shows how the design pattern may be implemented. Each part of the pattern may in this case be implemented either in hardware or in software. The following combinations are possible for the implementation:

- all the modules are implemented in hardware or software,
- the state transition 1 and SortInto( ) are implemented in hardware, while state transition 2 and SortOut( ) are implemented in software,
- the state transition 1 and SortInto( ) are implemented in software, while state transition 2 and SortOut( ) are implemented in hardware,
- SortInto( ) is implemented in hardware, and all the other parts are implemented in software,
- SortOut( ) is implemented in hardware, and all the other parts are implemented in software,
- SortInto( )(and SortOut( ) are implemented in hardware, and the rest of the process is implemented in software.

One major advantage in this case is that different synthesis techniques can be used for all four task elements. Suitable synthesis techniques are known from O. Bringmann et al., Mixed Abstraction Level Hardware Synthesis from SDL for Rapid Prototyping, $10^{th}$ IEEE International Workshop on Rapid System Prototyping, Clearwater, June 1999. Since the functions SortInto( ) and SortOut( ) generally have a high algorithmic component, architecture synthesis can be used for them, that is to say a special, application-specific processor is generated for these functions using a tool. If the two state transitions are implemented in hardware, these can be transferred directly to a simple hardware description at the registered transfer level (RTL), without using any optimizing methods (synthesis). This conceptual separation likewise considerably simplifies the hardware/software partitioning of the respective state transition.

The overlapping embodiment (pipelining) of the two modules is feasible provided that both modules do not wish to access the same memory cell in the memory at the same time. The semantics of the design pattern are always protected since, in the event of simultaneous access, one of the two functions is stopped and waits until the other function has finished.

Design of Complex Systems with the Modules:

The construction of a relatively complex system with the aid of modules which can be derived from the described design pattern will be explained using the example of a switching computer for data services with QoS requirements. The basic modules for traffic monitoring(Policy) and bandwidth allocation (Scheduler) are provided by instances in the design pattern.

The left-hand side of FIG. 7 shows the basic structure of the system. The incoming data streams, of which there are two in the example, are analyzed by means of the traffic monitoring(Policy). The traffic monitoring is provided with the aid of the design pattern (right-hand side in FIG. 7). The function SortInto( ), as shown in FIG. 7 was defined for this purpose.

In a switching computer such as this, a distinction is also drawn between control information and payload data. If the data stream contains control information, this information is sent to the monitoring module Control. The normal telecommunications protocols are then handled in this module. The information which describes the data flow (switching) in the system is generated in Control. This is done by Control setting the variable OutPID in the traffic monitoring. The switching is provided by there being a number of instances of the module Scheduler in FIG. 8, for example one for each output line, and by the data words being sent from the traffic monitoring to the appropriate bandwidth allocator. The addressing(by the variable OutPID) of the appropriate bandwidth allocator (Scheduler) results in a data stream being allocated to one output channel.

In principle, it is possible for there to be a number of traffic monitors (n inputs) at the input, and a number of modules of the Scheduler type (m outputs) at the output.

The definition of which bandwidth-limited channel will be implemented at this point depends on the costs and the requirements for the system. In principle, the bandwidth of the connecting channel is infinitely wide. Some possible variants are described, by way of example, in the following section.

Figure 9:
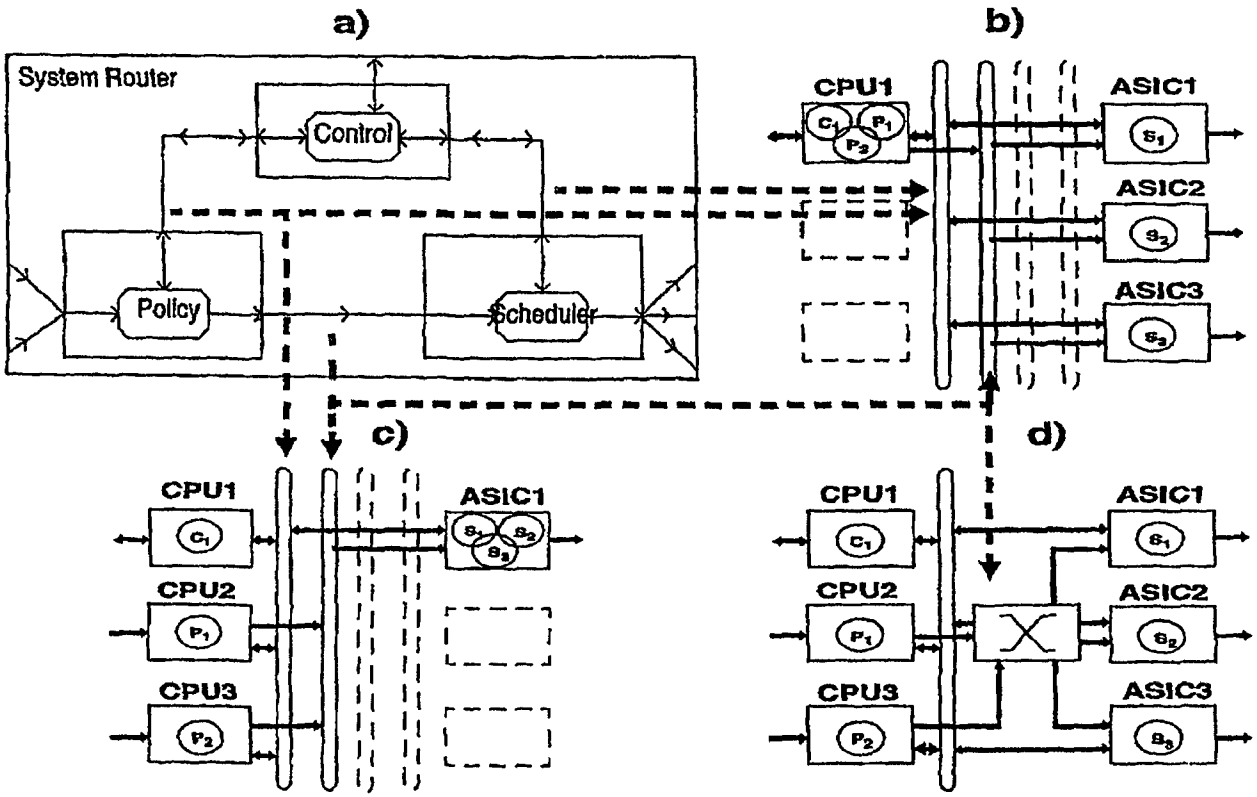

Automatic Derivation of a Complex System:

FIG. 9*a* shows the basic structure of the switching computer at the specification level. Various architectures can now be derived from this. Software modules are provided on processors (abbreviated CPU), while hardware modules are "cast" in ASICs (application specific integrated circuit). In the figure, a solid circle is in each case intended to show one instance of a design pattern, with P for Policy, S for Scheduler and C for Control being used as abbreviations. Communication channels can be mapped onto buses or switching modules.

The implementation in FIG. 9*b* has a processor for processing the two traffic monitoring instances (Policy), three hardware modules for the bandwidth allocation modules (Scheduler), a bus for transmitting data words and a bus for control information. In contrast to this, the architecture in FIG. 9*c* comprises three processors for the monitoring and traffic monitoring instances, and one hardware module to provide the Scheduler.

In FIG. 9*d*, in contrast, the switching functionality is not implemented by using a common bus, but via a switching module (space-division multiplexer).

Any other combinations of software and hardware modules are, of course, also feasible, for example only a portion of the Scheduler could be implemented in hardware, with the remaining portion being in software. Except for the Control module for providing the telecommunications protocols, all modules of the switching computer may be in the form of various instances in the design pattern.

The invention claimed is:

1. A method for producing a computer-aided real-time system having at least one processing unit (V1*a*, V1*b*, . . . ), wherein data is interchanged between the processing unit V1*a*, V1*b*, . . . ) and the environment or one or more further processing units (V2*a*, V2*b*, . . . ) synchronously or asynchronously, and wherein the processing unit (V1*a*, V1*b*, . . . ) has at least one associated real-time clock for correlation of the data interchange which is carried out in a computer system, characterized in that the real-time clock is defined by the following relationship:

$$C_r(t) = \left\lfloor \frac{C_c(t)}{T} \right\rfloor G_r \bmod R_v$$

where $C_r(t) \epsilon \mathbb{R}$ in [s]

$R_v$: value range, $R_v \epsilon \mathbb{R}$ in [s]

$G_r$: granularity, $G \epsilon \mathbb{R}$ in [s], where $G_r$ and $R_v$ are normalized with respect to the smallest unit that occurs:

T: clock period, $T \epsilon \mathbb{R}$ in [s], $C_c(t)=[1+g]\cdot C_i(t)+G(p^+,t)+S_o$, where $C_c(t) \epsilon \mathbb{R}$ in [s]

$C_i(t)=t$; $t \epsilon \mathbb{R}$ in [s]

g: accuracy of the clock, $g \epsilon \mathbb{R}$ for example the crystal accuracy in ppm.

$g(p^+,t)$ changing the accuracy of the clock with respect to time as a function of physical variables, represented by the vector $p^+$, for example the temperature $g(p^+,t) \epsilon \mathbb{R}$ $$G(p^+, t) = \int_{t_1}^{t_2} g(p^+, t)dt,$$

as the effective change in the accuracy in a time interval $(t_2-t_1)$ $S_o$: start offset, $S_o \epsilon \mathbb{R}$ in [s].

2. Method according to claim 1, wherein a numerical counter which is associated with the processing unit (V1*a*, V1*b*, . . . ) is controlled by means of the clock in accordance with the following relationship:

$$C_A(t) = \left\lfloor \frac{\left\lfloor \frac{C_C(t-\tau)}{T} \right\rfloor}{N_A} \right\rfloor \cdot G_A \bmod R_A$$

where $C_A(t)$: $\epsilon Z$

T: clock period of the discrete real clock $T \epsilon \mathbb{R}$ in [s], $N_A$: number of changes $N_A \epsilon \mathbb{N}$ $G_A$: granularity of the derived counter, $G_A \epsilon \mathbb{N}$, $R_A$: value range of the derived counter, $R_A \epsilon \mathbb{N}$, $\tau$: delay time, $\tau \epsilon \mathbb{R} \cup \{o\}$ in [s].

3. Method according to claim 2, wherein one of the clocks is used as a reference clock for synchronization of the other clock.

4. Method according to claim 2, wherein real-time control is used for the data interchange with the processing units (V1*a*, V1*b* . . . V2*a*, V2*b*, . . . ) for open-loop or closed-loop control of a technical process.

5. Method according to claim 2, wherein a data stream, which is received by a processing unit (V1*a*, V1*b*, . . . V2*a*, V2*b*, . . . ) and is formed from a sequence of data packets, is decoupled from a transmitted data stream, so that the transmitted data stream has a different sequence of data packets to that of the received data stream.

6. Method according to claim 2, wherein the processing unit (V1*a*, V1*b*, . . . ) has an associated queue.

7. Method according to claim 6, wherein the timing of the queue is controlled by the clock which is used as the reference clock.

8. Method according to claim 2, wherein the data packets are provided with a real-time marker that is produced by the clock.

9. Method according to claim 2, wherein the clock is used to define time limits, in particular time conditions or time requirements.

10. The method according to claim 1, wherein one of the clocks is used as a reference clock for synchronization of the other clock.

11. The method according to claim 1 wherein real-time control is used for the data interchange with the processing units (V1*a*, V1*b* . . . V2*a*, V2*b*, . . . ) for open-loop or closed-loop control of a technical process.

12. The method according to claim 1, wherein a data stream, which is received by a processing unit (V1*a*, V1*b* . . . . V2*a*, V2*b*, . . . ) and is formed from a sequence of data packets, is decoupled from a transmitted data stream, so that the transmitted data stream has a different sequence of data packets to that of the received data stream.

13. The method according to claim 1, wherein the processing unit (V1*a*, V1*b*, . . . ) has an associated queue.

14. The method according to claim 13, wherein the timing of the queue is controlled by the clock which is used as the reference clock.

15. The method according to claim 1, wherein the data packets are provided with a real-time marker that is produced by the clock.

16. The method according to claim 1, wherein the clock is used to define time limits, in particular time conditions or time requirements.

* * * * *